US007070484B2

(12) United States Patent
Wu et al.

(10) Patent No.: US 7,070,484 B2
(45) Date of Patent: Jul. 4, 2006

(54) PAD BREAK-IN METHOD FOR CHEMICAL MECHANICAL POLISHING TOOL WHICH POLISHES WITH CERIA-BASED SLURRY

(75) Inventors: Kuo-Chun Wu, San Jose, CA (US); Wee-chen Richard Gan, Santa Clara, CA (US); Karen Wong, Milpitas, CA (US)

(73) Assignee: Mosel Vitelic, Inc., Hsin Chu (TW)

( * ) Notice: Subject to any disclaimer, the term of this patent is extended or adjusted under 35 U.S.C. 154(b) by 0 days.

(21) Appl. No.: 10/851,549

(22) Filed: May 21, 2004

(65) Prior Publication Data

US 2005/0260924 A1 Nov. 24, 2005

(51) Int. Cl.
*B24B 1/00* (2006.01)

(52) U.S. Cl. ..... 451/57; 451/56; 451/41

(58) Field of Classification Search ..... 451/41, 451/60, 36, 37, 57, 59, 56, 443, 446
See application file for complete search history.

(56) References Cited

U.S. PATENT DOCUMENTS 6,135,863 A * 10/2000 Zhang et al. ..... 451/56
6,241,581 B1 * 6/2001 Miyashita et al. ..... 451/41
2005/0075056 A1 * 4/2005 Wu et al. ..... 451/57

* cited by examiner

*Primary Examiner*—Dung Van Nguyen
(74) *Attorney, Agent, or Firm*—MacPherson Kwok Chen & Heid LLP; Gideon Gimlan

(57) ABSTRACT

A chemical mechanical polishing (CMP) method is disclosed in which a new polishing pad is broken-in and conditioned into a steady operating state while using a silica ($SiO_2$) based CMP slurry and where the broken-in and conditioned pad is afterwards used for polishing patterned workpieces (e.g., semiconductor wafers) with a ceria ($CeO_2$) based CMP slurry. The approach shortens break-in time and appears to eliminate a first wafer effect usually seen following break-in with ceria-based CMP slurries.

18 Claims, 3 Drawing Sheets

90
100
101
102
(Patterned Wafers)
111
110
(Dummy Wafers)
120
111A
(First, Post-Polish Patterned Wafer)
155
150
Pad-Under-Break-In
PLATEN
151
130
183
WORKFLOW CONTROL COMPUTER
180
184
140
Sweep
Roughner /Conditioner
185
160
Rinse (DI H2O) Feed
161
Silica Slurry Feed
162
165
Ceria Slurry Feed
163
186

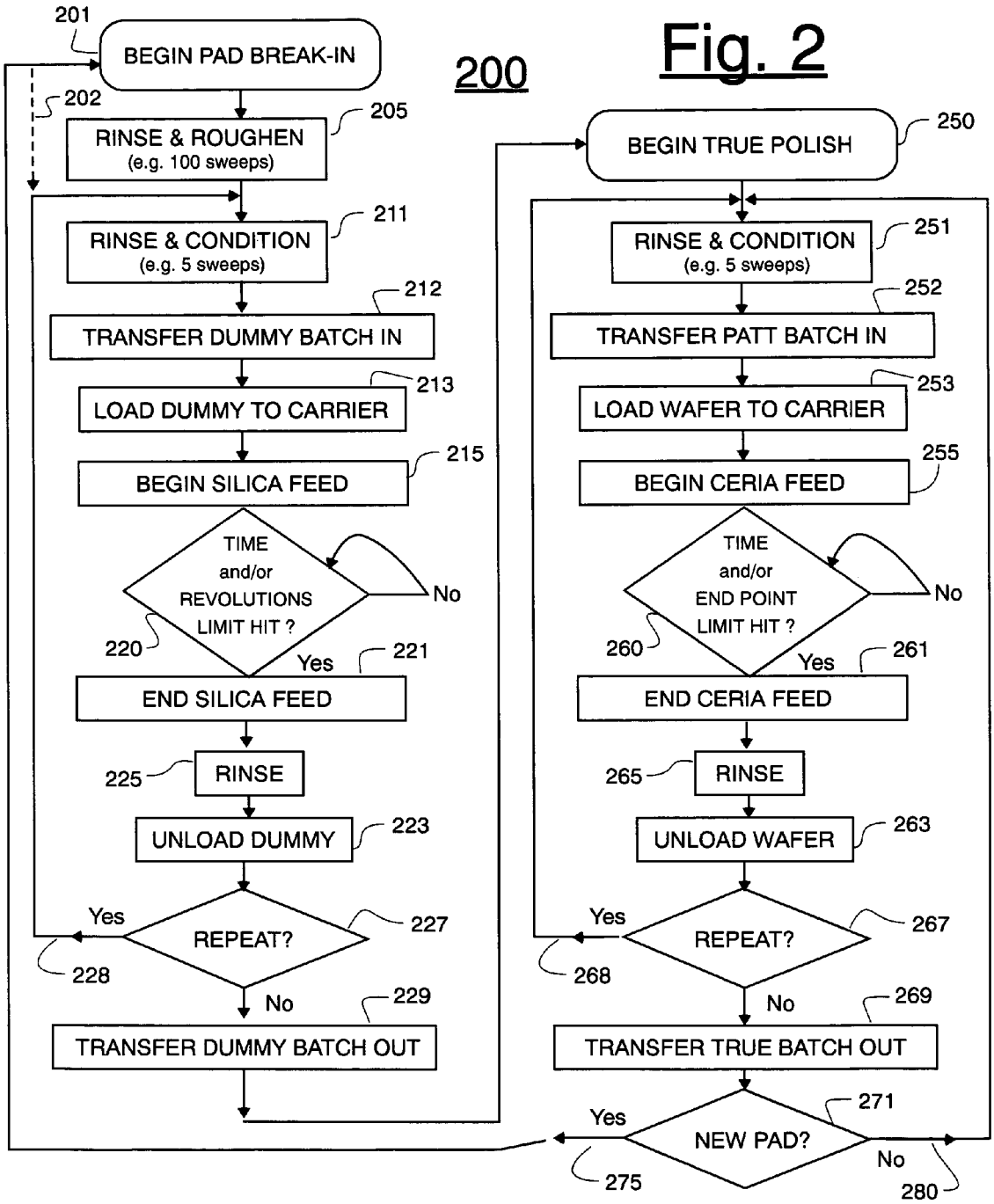
200
Fig. 2
201
BEGIN PAD BREAK-IN
202
205
RINSE & ROUGHEN
(e.g. 100 sweeps)
211
RINSE & CONDITION
(e.g. 5 sweeps)
212
TRANSFER DUMMY BATCH IN
213
LOAD DUMMY TO CARRIER
215
BEGIN SILICA FEED
TIME
and/or
REVOLUTIONS
LIMIT HIT ?
No
220
Yes
221
END SILICA FEED
225
RINSE
UNLOAD DUMMY
223
Yes
REPEAT?
227
228
No
229
TRANSFER DUMMY BATCH OUT
250
BEGIN TRUE POLISH
251
RINSE & CONDITION
(e.g. 5 sweeps)
252
TRANSFER PATT BATCH IN
253
LOAD WAFER TO CARRIER
255
BEGIN CERIA FEED
TIME
and/or
END POINT
LIMIT HIT ?
No
260
Yes
261
END CERIA FEED
265
RINSE
UNLOAD WAFER
263
Yes
REPEAT?
267
268
No
269
TRANSFER TRUE BATCH OUT
271
Yes
NEW PAD?
No
275
280

PAD BREAK-IN METHOD FOR CHEMICAL MECHANICAL POLISHING TOOL WHICH POLISHES WITH CERIA-BASED SLURRY

FIELD OF DISCLOSURE

The present disclosure of invention relates generally to Chemical Mechanical Polishing (CMP).

The disclosure relates more specifically to mass production of semiconductor devices and to economical chemical mechanical polishing of wafers with self-planarizing CMP slurries such ceria-based CMP slurries. The disclosure relates yet more specifically to an operation known as pad break-in and initial conditioning.

DESCRIPTION OF RELATED ART

As its name implies, Chemical Mechanical Polishing (CMP) generally uses a combination of mechanical material removal and chemical material removal mechanisms for polishing the surface of a supplied workpiece to a desired smoothness and/or planarity. Some forms of CMP rely more so on chemical removal mechanisms while other forms of CMP rely more so on mechanical and/or other removal mechanisms. By way of example, silica-based CMP slurries typically rely more on mechanical abrasion mechanisms for removing material while ceria-based CMP slurries typically rely more on chemical reaction and surface tension mechanisms for removing material. The material that is being removed can be an outer oxide-coating of a semiconductor wafer.

When CMP is carried out, a slurry composed of mechanically-abrasive particles and/or chemically-reactive particles and/or surfactants and/or other materials is typically deposited onto a disk-shaped polishing pad. The polishing pad usually rotates to bring the CMP slurry into working contact with a to-be-polished workpiece. As polishing progresses, debris-containing old slurry is discharged from the rotating pad and fresh new slurry is continuously fed onto the pad to replace the discharged old slurry. In a typical setup, the pad is mounted on a rotating platen so that the slurry-coated pad surface will move into engagement with a counter-rotating workpiece. The to-be-polished surface of the workpiece is brought face-down into pressurized contact with the rotating and slurry-coated, polishing pad so that the slurry can remove a desired amount of surface material from the workpiece. At the end of the polishing process, the workpiece is typically rinsed to remove left over debris and slurry material from its surface. The polishing pad may also be rinsed, reconditioned and/or loaded with fresh new slurry in between polishings.

The composition of the slurry is but one of numerous factors that determine the outcome of a chemical mechanical polishing operation. The composition and surface topography of the to-be-polished surface is a factor. The composition and surface topography of the polishing pad is a factor. Polishing pads are typically composed of polyurethane or like materials that have a relatively homogenous distribution of pores in their interior. The liquid slurry can work its way into the pores during polishing so as to provide a fairly uniform sea of slurry-containing pockets. For more uniform slurry distribution, it is often desirable to create additional grooves, channels and/or scratched areas on the pad surface for holding the slurry. This is typically done with repeated pad roughening operations. After a polishing pad has been used for a long time, various desirable characteristics of the pad tend to degrade and a time comes when it is prudent to replace the aged pad with a new one.

New polishing pads are often shipped by manufacturers with a smooth, knife-cut, outer surface. The smooth outer surface of the polishing face often has to be roughed away in order to expose internal pores within the new pad and to create microgrooves, channels and/or other slurry-holding topographical features. The process of roughening the polishing face of a new pad is part of a larger operation known as pad break-in. In mass-production environments it is often desirable to carry out the roughening process beyond what may be minimally needed on any singular pad so that a margin of safety is provided. The margin of safety should assure in a statistical sense that a statistically acceptable percentage of all pads will be properly roughened prior to their being used for polishing actual workproduct (non-dummy wafers). Roughening may be carried out even if the polishing pad is not a new one with a knife-cut, substantially planar working surface. The purpose of roughening is usually to bring the polishing pad into a known state for furthering the carrying out steady-state polishing when the original state of the pad is unknown or known to be unroughened. The furthering of steady-state polishing may include pre-conditioning with dummy-wafers as shall now be described.

Typically, the pad roughening step is followed by a dummy initialization process wherein a number blank wafers (dummy wafers with essentially no topographical surface patterns on them) are run through the polishing tool so as to further condition the polishing pad and stabilize its performance into a steady state. This is done so that statistically uniform interaction will be seen with subsequent wafers. The subsequent, nondummy wafers will include ones that have working (operable) circuit patterns defined in them rather than being blank.

The described, pad roughening and subsequent pad initializing operations are but two of many variable factors that can affect how subsequent chemical mechanical polishing operations proceed. Some of the more important other parameters include: (1) platen velocity (V), (2) workpiece pressure (P), (3) workpiece smoothness, (4) slurry composition, and (5) slurry feed rate. Among these, the composition (4) of the CMP slurry plays a particularly vital role in determining what kinds of surface materials may be polished and to what degree of smoothness and/or planarity. If the slurry is too abrasive and/or reactive, it may remove surface material too quickly and cause irreparable damage to the to-be-polished workpiece. If the slurry is not abrasive/reactive enough, it may take an unacceptably long amount of time and/or energy to polish a workpiece down to a desired state.

Silica ($SiO_2$) based CMP slurries have been conventionally used for polishing oxide-coated semiconductor wafers. However, such silica-based slurries are relatively nonselective and they tend to remove stop layer materials (e.g., silicon nitride) at about the same rates as they remove silicon oxide. Overpolishing becomes a problem, particularly when the to-be-polished wafers are structured to provide active devices (e.g., transistors) with submicron critical dimensions (e.g., channel lengths of less than 0.18 μm). In particular, silica-based slurries have been found to be too nonselective and not planarizing enough when used for planarizing so-called, deep-submicron Shallow Trench Isolation (STI) wafers after trench filling. The latter wafers have an HDP oxide coating that needs to be removed to expose but not damage an underlying silicon nitride layer and a plurality of oxide-filled trenches extending down from the nitride layer.

Because of such problems, researchers have begun to experiment with ceria ($CeO_2$) based CMP slurries as alternatives to the more traditional silica-based slurries.

Ceria-based slurries have the advantage of offering relatively high selectivity for removal of silicon oxides over other compounds (e.g., silicon nitrides) and their surfactant content is believed to inherently drive the polishing process towards a higher degree of planarity than is generally possible with silica-based slurries. However, ceria-based slurries are not without their set of drawbacks. Ceria-based CMP slurries tend to be more expensive on a per unit volume basis than silica-based CMP slurries. Additionally, ceria-based slurries appear to be slower acting, meaning that it can take much longer to polish patterned silicon oxide down to a desired depth using a ceria-based slurry in place of a silica-based slurry. It is not fully understood why this is so. The ceria-based chemical mechanical polishing mechanism tends to be more chemical in nature and less mechanical than the counterpart, silica-based CMP mechanism. Surfactants included in most ceria-based CMP slurries cause the slurry to be sensitive to surface topography. Thus the rate of material removal by ceria-based CMP slurries tends to be more sensitive to the chemical composition of the material being removed and to the surface topography of the layer that is being polished. In short, ceria-based CMP slurries are not interchangeable with silica-based CMP slurries because the two types of slurries operate with substantially different chemical and/or mechanical polishing mechanisms.

The drawbacks of the ceria-based slurries extend into the pad break-in, initialization and conditioning operations of a CMP tool. It has been observed that CMP tools which use ceria-based CMP slurries tend to take longer than their silica-based counterparts in completing their post-roughening, pad initialization and conditioning operations. It is not fully understood why this is so. However, even after using twice as many dummy wafers (which equates roughly to twice as much time) for post-roughening, pad initialization and conditioning, the ceria-based CMP tools appear to still exhibit an undesirable, "first wafer effect". (That is, statistically speaking, there is noticeable variation between polishing time and/or cross-wafer planarity between the first non-dummy wafer in a batch of non-dummy wafers and the remainder of the wafers in the same non-dummy batch.)

This statistical variation is contrary to the objective of the post-roughening, pad initialization and conditioning operations. The objective is to avoid the "first wafer effect" by exercising a new pad with enough dummy wafers and for sufficiently long a time per dummy so as to bring the new pad's polishing surface into a statistically-acceptable, steady state condition. (What constitutes statistically-acceptable can vary from one application to the next. Generally, a polish-to-end-point time variation of greater than about 50% is not statistically-acceptable.) After break-in, when a first batch of non-dummy wafers (patterned wafers) is loaded into the tool, the initialized new pad should behave statistically as if it had already been exposed to a steady stream of previous wafers and the chemical mechanical polishing of the non-dummy wafers should then proceed uniformly from wafer to wafer and batch to batch in a statistical sense. If a steady state polishing behavior is not attained by the time the first batch of patterned wafers is inloaded into the CMP tool then the first one, or first few, patterned wafers may not polish within a same per-wafer time and/or to the same uniformity as do the patterned wafers which follow them. Depending on process tolerances, the first one or few patterned wafers may have to be discarded if they show too much of a "first wafer effect". Discarding of patterned wafers is highly undesirable. This practice reduces yield in the mass production line. All the time and effort that had been expended in patterning the wafer and successfully getting it to the ceria based CMP step are lost.

The costs of using a ceria-based, break-in/conditioning and polishing process tends to be substantially larger than those associated with using silica-based slurries. Part of the extra cost comes from the ceria-based polishing tool being used for a longer period of time (and/or being used with a larger number of dummy wafers) to initialize a new polishing pad into steady state just after that pad had undergone break-in roughening. More of the extra cost can come from the consumption of larger amounts of consumables during the longer post-break-in conditioning, particularly because larger amounts of the expensive ceria slurry are being consumed.

INTRODUCTORY SUMMARY

Structures and methods may be provided in accordance with the present disclosure of invention for improving over the above-described drawbacks of ceria-based chemical mechanical polishing, and in particular, the pad break-in operation.

More specifically, a set of experiments were performed to see if a less expensive silica-based slurry can be used during pad break-in and dummy conditioning/initializing even though ceria-based slurry is being used for the actual polishing of subsequent workproduct (e.g., Shallow Trench Isolation (STI) wafers). The worry was that some of the silica-based slurry material will remain in the new pad's pores and interfere with the ceria-based CMP mechanisms that occur when polishing of actual workproduct (non-dummy wafers) follows. In particular the worry was for the first wafer in post-dummy batch, where that wafer is already subject to the first wafer effect. Surprisingly, it was found that there was no interfering effect seen from using silica-based slurry during pad break-in/conditioning even though ceria-based slurry is afterwards used for the actual polishing. More surprisingly, it was found that the first wafer effect which had been seen when ceria-based CMP slurries were used for pad break-in, disappeared or was substantially reduced. The reasons for the abatement of the first wafer effect are not yet fully understood.

In accordance with one set of aspects of the present disclosure, techniques are provided for allowing one or more of the following:

1) Shorter conditioning time and/or use of a fewer number of dummy wafers in the post-roughening pad-initialization that precedes ceria-based chemical mechanical polishing of STI (Shallow Trench Isolation) and/or like workpieces;
2) More economical conditioning when using of dummy wafers while nonetheless using ceria-based chemical mechanical polishing of STI and/or like workpieces; and
3) Elimination or reduction of the first wafer effect in a mass production line that employs ceria-based chemical mechanical polishing.

A chemical mechanical polishing method in accordance with the disclosure may comprise: (a) installing a new polishing pad into a CMP tool which uses ceria (CeO2) based CMP slurries or equivalents for chemical mechanical polishing of non-dummy workpieces; (b) roughening the newly-installed polishing pad; (c) transferring a batch of dummy workpieces into the CMP tool; (d) using one or more of the in-transferred dummy workpieces in combination with one or more silica ($SiO_2$) based CMP slurries or equivalents to condition the roughened and newly-installed polishing pad; (e) unloading the batch of dummy workpieces from the CMP tool; (f) transferring a batch of non-dummy workpieces into the CMP tool; and (g) using the conditioned new polishing pad and one or more of the in-transferred non-dummy workpieces in combination with one or more Ceria (CeO2) based CMP slurries or equivalents to polish the one or more of the in-transferred non-dummy workpieces.

A chemical mechanical polishing (CMP) tool in accordance with the disclosure may comprise: (a) a first port for receiving a silica ($SiO_2$) based CMP slurry; (b) a second port for receiving a ceria ($CeO_2$) based CMP slurry; (c) a third port for receiving a rinsing fluid; (d) a platen for receiving and supporting a polishing pad; (e) an automated slurry deliverer which selectively delivers one or more of the fluids of the first, second and third ports to an installed polishing pad; and (f) an automated workflow controller which causes the automated slurry deliverer to deliver at least the silica ($SiO_2$) based slurry during break-in and conditioning of a newly-installed polishing pad and which causes the automated slurry deliverer to deliver at least the ceria ($CeO_2$) based slurry for polishing of non-dummy workpieces during post break-in use of the newly-installed polishing pad. Such a CMP tool may further include: (f.1) a time measurement means and/or revolutions-counting means for determining how long the silica based slurry will be selectively delivered; and (f.2) an end-point detection means for determining when delivery of the ceria ($CeO_2$) based abrasive slurry terminates.

Other aspects of the disclosure will become apparent from the below detailed description.

BRIEF DESCRIPTION OF THE DRAWINGS

The below detailed description section makes reference to the accompanying drawings, in which:

FIG. 2 is a flow chart of a method for carrying out pad break-in and ceria ($CeO_2$) based polishing in accordance with the present disclosure.

DETAILED DESCRIPTION

Figure 1A:
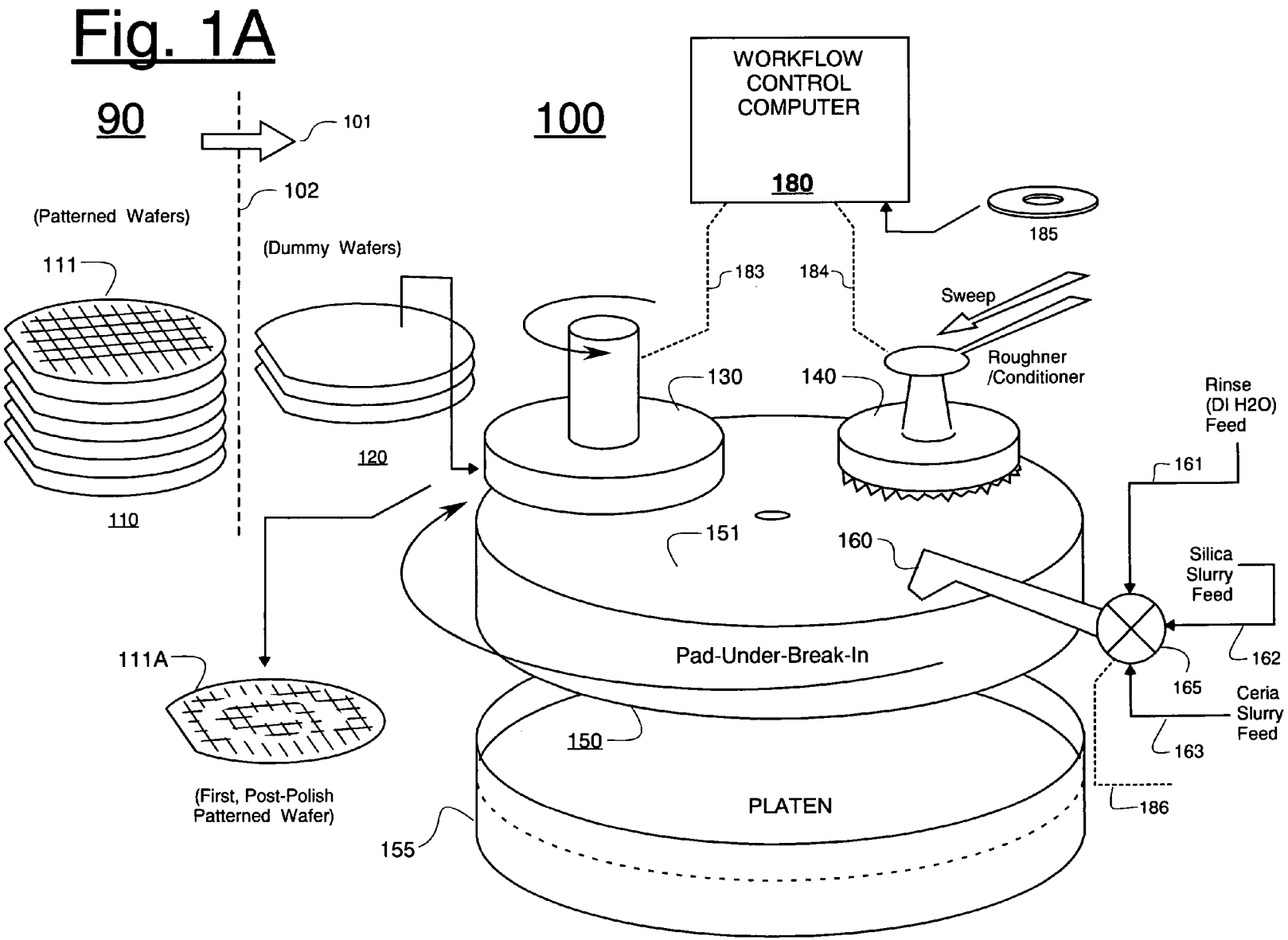
FIG. 1A is a schematic diagram illustrating parts of a CMP tool which uses a polishing pad and a ceria ($CeO_2$) based CMP slurry to polish supplied batches of workpieces and which also uses a silica ($SiO_2$) based CMP slurry during break-in and conditioning of a newly-installed polishing pad.

FIG. 1A is a schematic diagram of part of a mass production line which uses a chemical mechanical polishing (CMP) tool 100 to polish supplied batches of workpieces such as the illustrated batch 110 of patterned STI wafers. The patterned batch 110 is shown outside a transfer boundary 102 of the tool 100. The CMP tool 100 uses a periodically replaced, polishing pad 150 and a ceria ($CeO_2$) based CMP slurry (162) to polish in-transferred batches of workpieces such as batch 110.

In the illustrated example, a rotatable platen 155 supports the replaceable polishing pad 150. (The platen is shown exploded away from the pad for illustration purposes.) An independently rotatable carrier 130 grabs respective ones of in-transferred workpieces (e.g., patterned semiconductor wafers) and brings them into face-down pressurized contact with a working surface 151 of the rotating polishing pad. A fluid dispensing arm 160 delivers selected ones of a rinse fluid 161 (e.g., Delonized water), a silica-based slurry 162, and a ceria-based slurry 163 to the working surface 151. A computer-controlled valve 165 determines which of the fluids 161–163 will be dispensed and when. Electrical link 186 carries valve control signals from a workflow controlling computer 180. (As used herein, silica-based CMP slurries refer to any one or more mixtures which include a substantial amount of $SiO_2$ particles for carrying out a chemical mechanical polishing process. Further as used herein, ceria-based CMP slurries refer to any one or more mixtures which contain a substantial amount of $CeO_2$ particles for carrying out a chemical mechanical polishing process).

A diamond studded roughening/conditioning disk 140 is further provided for sweeping across the working surface 151 of the pad and for roughening and/or conditioning the working surface 151 during pad break-in and/or conditioning operations. Other forms of roughening/conditioning means in addition to, or as alternatives for the diamond studded and/or disk-shaped kind (140) are of course contemplated. Roughening may be distinguished from conditioning by the greater degree to which the roughening/conditioning disk 140 is used while it is roughening a pad rather than merely conditioning the pad. The greater degree of use may be measured in terms of a greater number of sweeps, and/or a slower sweep rate, and/or a faster platen velocity and/or longer use time of the roughening/-conditioning disk 140, where any one or more of these factors can produce more vigorous interaction between the roughening/conditioning disk and the corresponding working surface 151 of the pad. By way of example, in one embodiment, the use of about 50 or more successive sweeps by disk 140 may be considered as a roughening operation while the use of no more than about 6 successive sweeps by disk 140 may be considered as a conditioning operation. Roughening may be immediately followed by a conditioning operation. An electrical link for controlling the roughening/conditioning disk means 140 is shown at 184. An electrical link for controlling the workpiece carrier 130 is shown at 183.

A control computer 180 is operatively coupled to the various parts of the CMP tool 100 for sending control commands to the tool and/or receiving sensor signals from the tool. One or more computer programs 185 may be loaded into the control computer 180 from tangible computer media (e.g., CD-ROM disk) and/or from a communications network in the form of manufactured instructing signals so as to cause the computer 180 to carry out operations described herein.

For purpose of illustration, the polishing of an STI workpiece 111 with a ceria ($CeO_2$) based CMP slurry is briefly described. The workpiece 111 may be a wafer that has a monocrystalline semiconductor substrate (e.g., silicon) and various other material layers formed on the substrate, including a silicon nitride layer (not explicitly shown) and a High Density Plasma (HDP) oxide layer deposited on top of the nitride layer. The HDP oxide fills a patterned plurality of tiny trenches so as to provide Shallow Trench Isolation for active devices (e.g., transistors) which will be later created in the wafer. The CMP tool 100 is to be used to precisely polish away an upper portion of the HDP oxide so as to fully expose the underlying nitride layer without eroding away too much of the nitride layer. When patterned workpieces are moved into the tool 100, the workpieces are typically transferred through a transfer port 102 of the CMP tool as batches of alike workpieces. Typically such an inloaded batch of workpieces (e.g., 110) will have 10 or more workpieces. A common number is 25 workpieces per patterned batch. If a batch of dummy-wafers 120 is transferred into the tool for pad break-in purposes, such a batch may have only a handful of dummy-wafers, say 5–10 unpatterned wafers.

Despite its apparent simplicity, there can be many variable parameters to control within the CMP tool, including polish pressure (P), pad velocity (V), slurry feed rate (F), rinse feed rate (R), roughener sweep rate, and the length of time and sequence in which various actions occur. FIG. 1A implies that a first batch 120 of unpatterned (blank) wafers will be transferred through boundary 102 into the tool 100 and used for conditioning a fresh and newly-installed polishing pad 150. Afterwards, a second batch, 110 composed of patterned wafers (e.g., STI wafers) will be batch-transferred 101 from a position 90 outside the tool, through the tool's transfer boundary 102 and into the tool 100 for polishing in the tool with a ceria-based slurry (163). The first of the polished real wafers, 111 is of particular interest because its post-polish state 111A may exhibit a first wafer effect which causes that patterned wafer to be substantially different from subsequently polished ones of the same or a next batch.

Figure 1B:
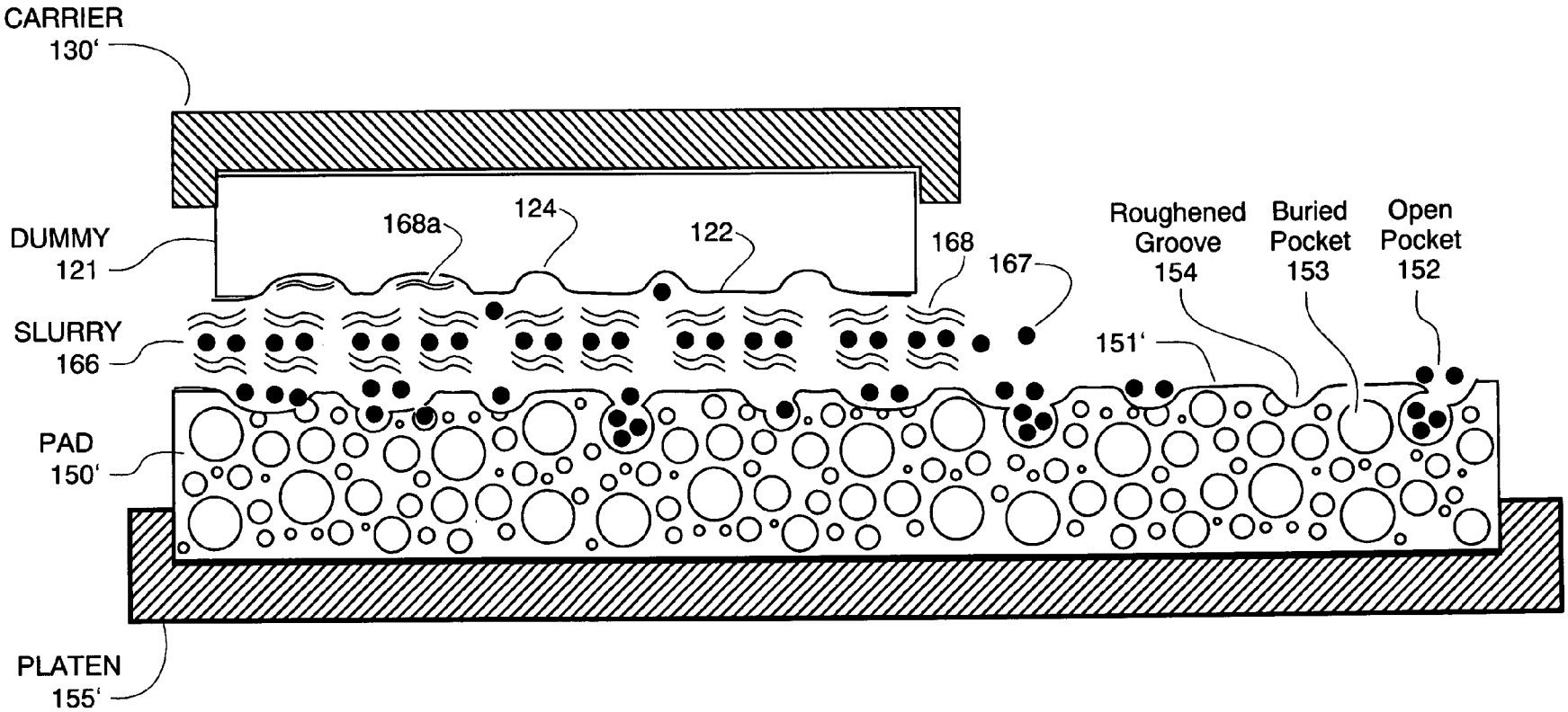
FIG. 1B is a schematic cross sectional view for explaining possible interactions between pad, slurry, and dummy wafer when a newly-installed polishing pad is being conditioned.

Referring to FIG. 1B, a not-to-scale schematic cross section is provided for explaining some additional nuances of the pad break-in and conditioning process. The pad may initially have a fairly planar and smooth surface prior to roughening, with just a few pockets or voids (e.g., 152) being opened and exposed at the top surface. After roughening, the surface 151' of the pad 150' will usually have a statistically uniform distribution of additional grooves, channels, or other kinds of surface voids and/or indentations (154) defined uniformly across the working surface for containing and moving the slurry 166. Voids which may have been previously buried (153) may open up as a result of roughening and/or conditioning. The surface 122 of the dummy wafer 121 may develop its own microscratches, grooves, channels, or other kinds of surface voids and/or indentations (124) for containing solid particles 167 and/or fluid parts 168 of the slurry 166. If a ceria-based CMP slurry is used, the slurry will typically include surfactants 168*a* which preferentially adhere to the bottom of micro-troughs formed on the wafer. This surface-tension based adhesion is believed to encourage the solid particles 167 of the slurry to more aggressively erode away the hillocks of the wafer and to thereby drive the CMP process towards inherently providing planarity on the wafer surface. Such planarity, however, may be counterproductive to bringing the pad surface 151' into steady state for later-arriving non-dummy wafers because those non-dummy wafers will usually have non-planar surfaces (e.g., due to the formation of isolation trenches in the case of STI wafers).

Referring to FIG. 2, the combination of a pad break-in operation and post break-in polishing will be described as constituting a workflow 200 in accordance with the present disclosure. At starting step 201, a new polishing pad (150, e.g., having a knife cut and thus unroughened surface) is understood to have been installed into the tool (onto platen 155) and the workflow computer (180) has been signaled to begin a pad break-in operation.

At step 205, the workpiece carrier 130 has been retracted away from the rotating pad 150. Rinse fluid 161 is sprayed onto the upper surface 151 of the pad and the roughening/conditioning disk 140 engages with the pad to make sweeping motions across the pad surface 151 between its inner and outer working circumferences. This begins a rinse-and-roughen operation (205) which is typically constituted by a large number of such roughening sweeps and continuous rinse application, for example at least about 20 to 50 successive sweeps, and more so about 100 sweeps in one embodiment. A similar operation with a substantially fewer number of sweeps (e.g., less than about 10 successive sweeps) is referred to here as a rinse-and-condition operation (211). In one embodiment, the rinse-and-condition operation (211) is constituted by about 5 sweeps of the roughening/conditioning disk 140. The purpose of the rinse-and-roughen operation 205 is to roughen the surface 151 of a fresh new pad, to create a statistically uniform distribution of additional grooves, channels, or other kinds of surface voids and/or indentations (155 of FIG. 1B) even before initialization slurry (166) is applied. The purpose of the rinse-and-condition operation 211 is to further randomize the distribution of topologic features on the pad surface, where this randomizing may occur before and/or after slurry has been deposited on the pad. The definition of roughening does not have to be limited to a specific number of successive sweeps. It is the end result of the process that is important, namely, that a substantially greater number of additional grooves, channels, or other kinds of surface voids and/or indentations are uniformly added across the working surface to thereby provide the pad with a near steady state distribution of such surface voids and/or indentations. As already indicated roughening may be achieved by more vigorous use of the roughening/conditioning disk 140, such as by increasing platen rotation speed and/or increasing pressure of the disk 140 against the pad surface 151 and/or by extending the engagement time between disk 140 and the entirety of the working area (polishing area) of pad surface 151.

At step 212, a batch 120 of dummy-wafers is transferred into the tool interior. In one embodiment, there are about 5 blank wafers in the dummy batch.

At step 213, a first of the dummy-wafers is loaded onto the workpiece carrier 130. Silica slurry feeding (162) begins at step 215 in conjunction with the loaded dummy-wafer being pressed against the rotating pad. The rinse-and-condition operations of step 211 should have completed by this time so that the rinse fluid is turned off and the roughening/conditioning disk means 140 is retracted. A time-measuring algorithm in the workflow computer 180 may keep track of how long the dummy-wafer interacts with the slurry-covered pad. Alternatively or additionally, a revolutions counting algorithm may be included in the workflow computer 180 for keeping track of how many revolutions the slurry-covered pad makes while the dummy-wafer is engaged with the pad and/or for keeping track of how many revolutions the wafer makes.

Step 220 tests for expiration of a conditioning limit. The conditioning limit could be defined by either one or both of a predefined time limit and a predefined revolutions count limit. In one embodiment, a time limit of about 60 seconds per dummy-wafer has been found effective for providing an acceptable degree of post break-in conditioning. If the time limit is too short, the subsequent polishing of patterned wafers may not be uniform in a statistically meaningful and acceptable way. If the time limit is too long, production throughput will suffer and there will be little if no effect on the statistical uniformity of the subsequently polished, non-dummy wafers.

At step 221, the conditioning termination limit has been encountered. In response, the feeding of silica-based slurry (162) is terminated. The workpiece carrier 130 continues to keep the dummy-wafer in rotating engagement with the counter-rotating pad while the rinse fluid (161) is turned on in step 225. This operation 225 mimics a later rinsing (265) of non-dummy wafers and is carried out for roughly the same amount of time as will be the non-dummy rinsing operation 265. In one embodiment, it is about 10 to 30 seconds.

In step 223, the just-used dummy-wafer is unloaded from the carrier and positioned for transfer out of the tool. Step 227 determines whether the next dummy-wafer will be similarly used for pad initialization. If the answer is yes, path 228 brings the tool back to step 211. Typically all of the wafers in the dummy batch 120 will be used for break-in conditioning and initialization. When a predefined end count for the dummy-batch is reached or step 227 otherwise provides a NO answer, the batch of dummy-wafers is transferred out of the tool as indicated in step 229.

Step 250 begins a true polishing operation in which a batch (110) of patterned wafers (e.g., STI wafers) will be polished. Most of the steps are similar to the conditioning with the dummy-wafers and so they can be described quickly. One difference is that the wafers now being polished have patterns and thus interact differently with the pad and slurry. (By way of example, friction and temperature can be different.) Another difference is that the slurry includes a ceria-based slurry. A rinse and conditioning (e.g., 5 sweeps) occurs at step 251. A first batch (110) of patterned wafers is transferred in at step 252. A next successive one in the in-transferred batch of wafers is loaded onto the carrier (130) at step 253. Dispensing of ceria-based slurry onto the pad begins at step 255. Testing for the end of ceria-based polishing occurs in step 260. One or both of elapsed time testing and end-point testing may be used. In one embodiment, test step 260 is based only on end-point testing wherein the termination of ceria-based polishing is indicated by one or more of various end-point determination techniques including: (a) optical detection, (b) temperature detection, (c) force feedback detection and/or (d) chemical trace analysis of waste slurry. The end-point detection mechanism supplies a completion signal (Yes) for step 260, indicating that a particular layer (e.g., a silicon nitride layer) of the patterned wafer has been fully exposed and that the current polishing is to stop.

In step 261, the dispensing of the ceria-based slurry is responsively halted. In step 265, the wafer is rinsed. In step 263 the rinsed wafer is unloaded from the carrier (130) and positioned for transfer out of the tool. At step 267, a determination is made as to whether there is another patterned wafer to be polished. If the answer is Yes (268), the process returns to step 251 for a pre-polish rinse conditioning of the pad. If the answer is No, the batch of patterned wafers is transferred out of the tool in step 269.

In step 271, a determination is made as to whether a fresh new polishing pad should be installed. Determination 271 can be machine-implemented so that replacement automatically to occurs after a predefined number of patterned wafers have been polished and/or a predefined amount of time has passed (leading to aging of the in-tool pad) and/or a predefined number of sweep by the conditioner means (140) has been made. If the answer is No (280), the process returns to step 251 for a pre-polish rinse conditioning of the pad. If the answer is Yes, path 275 is followed to begin a pad break-in operation after the new polishing pad is installed. In one embodiment, determination step 271 may also decide whether a dummy-reconditioning of the pad should occur without pad replacement and/or break-in. If that is the case, a bypass (202) may be made of one or both of the installation of a new pad and of the rinse-and-roughen operation 205.

EXAMPLE

Reduction of the first wafer effect is evidenced by the following experiments. In a baseline-defining first experiment (Table 1), pad break-in and post break-in conditioning and initialization were carried out using only a ceria-based slurry. Polishing of the patterned wafers was also conducted only with the same ceria-based slurry. The patterned wafers were constituted by Shallow Trench Isolation (STI) wafers that started with more than 6000 Å of HDP oxide (as measured from trench bottoms) deposited on trench-etched silicon wafers having a silicon nitride sacrificial layer on top of the trench mesas. For reasons unrelated to pad break-in, each HDP layer was pre-polished to a smaller thickness of about 6000 Å (as measured from trench bottoms) before being used in the post-break-in tool of the experiment. The pre-polishing did not reach down to the silicon nitride sacrificial layer. An end point detect method was used for detecting when the polishing reached the silicon nitride sacrificial layer in the post-break-in tool of the experiment. Final oxide thickness (as determined from trench bottoms) and cross-wafer variation were measured for a subset of the wafers. Polishing rate with the post-break-in pad can be calculated from the measured results as 6000 Å minus the measured ending thickness of oxide divided by polishing time (Rate=$\{6000-T_{end}\}$/Time). While all wafers were measured for time to endpoint detection, not every test wafer was measured for ending oxide thickness and planarity (range). Only wafer numbers 0, 1, 5, 15, and 20 were so measured. It may be seen from the time measurement column of Table 1 that wafer #0 had a substantially longer time to endpoint detection than any of remaining wafers #1–#23. The results of wafers #22–#23 appear anomalous and their rows are marked by double asterisks () in Table 1. They were not counted in determining average polish time for the batch. Ceria-based conditioning time was approximately 1 minute per dummy-wafer in the experiment of Table 1 and 10 dummy-wafers were used in the conditioning batch. Thus, the total break-in time was more than about 10 minutes. Ceria-based polishing was end-point terminated with friction based detection of the nitride underlayer. Table 1 shows uniformity results across the baseline batch of nondummy-wafers after the ceria-based break-in was carried out. Wafer 0 was also not counted in the calculation of the average because it is clearly different from the rest. The ending, average oxide thickness for the five measured wafers (0, 1, 5, 15, and 20) is assumed to be the average for wafer numbers 1–21. The calculated, average polish rate (polish to end-point) for the batch average was 35.14 Å/sec. By contrast, the calculated, polish rate for wafer number 0 (the first wafer after pad break-in) was 24.74 Å/sec which is about 30% slower. This is indicative of first wafer effect because the pad is not polishing as fast as it does with the remainder of the non-dummy wafer batch. Probably, the pad started out polishing non-dummy wafer #0 even at a slower rate than this and the rate picked up as the pad became further conditioned by the topographic features of the first non-dummy wafer. Polish rate variations for the other measured wafers (1, 5, 15, and 20) was about in the range of about ±10%. There was a big improvement in polishing rate when switching from wafer#0 to wafer#1. Wafer number 0** therefore clearly behaved differently than most of the subsequent wafers in the batch. This large variation constitutes a first wafer effect that is attributed to the pad break-in process.

TABLE 1

| STI Wafer No. after break in | Ending Oxide Thick (Å) | Oxide Thick Range (max-min, Å) | Measured time to end point detection (seconds) | Polish Rate = (6000-Thick)/time | Variation relative to AVG Polish Rate (35.14) | First wafer effect present ? |
|---|---|---|---|---|---|---|
| | | | Ceria-slurry Break-in/Conditioning (Raw Data plus Normalized Data) | | | |
| 0 | 4936 | 548 | 43.0 | 24.74 | −29.60% | Yes |
| 1 | 4944 | 552 | 26.5 | 39.85 | 13.40% | No |
| 2 | n/a | n/a | 27.2 | | | No |
| 3 | n/a | n/a | 29.1 | | | No |
| 4 | n/a | n/a | 28.5 | | | No |
| 5 | 4978 | 554 | 28.8 | 35.49 | 1.00% | No |
| 6 | n/a | n/a | 29.7 | | | No |
| 7 | n/a | n/a | 28.5 | | | No |
| 8 | n/a | n/a | 28.2 | | | No |
| 9 | n/a | n/a | 27.9 | | | No |
| 10 | n/a | n/a | 30.7 | | | No |
| 11 | n/a | n/a | 29.5 | | | No |
| 12 | n/a | n/a | 30.3 | | | No |
| 13 | n/a | n/a | 29.3 | | | No |
| 14 | n/a | n/a | 29.7 | | | No |
| 15 | 4976 | 489 | 31.5 | 32.51 | −7.48% | No |
| 16 | n/a | n/a | 30.9 | | | No |
| 17 | n/a | n/a | 31.3 | | | No |
| 18 | n/a | n/a | 31.9 | | | No |
| 19 | n/a | n/a | 31.0 | | | No |
| 20 | 4954 | 465 | 31.7 | 33 | −6.09% | No |
| 21 | n/a | n/a | 30.5 | | | No |
| 22 | n/a | n/a | 35.9 | ** | | n/a |
| 23 | n/a | n/a | 34.1 | ** | | n/a |
| AVG of 1–21 | 4958 | | 29.65 | 35.14 | 0.00% | |

In a second experiment (Table 2), pad break-in and post break-in conditioning were carried using only a silica-based slurry. Polishing of the patterned wafers was also conducted with the same ceria-based slurry as in the baseline first experiment. The patterned wafers were again constituted by Shallow Trench Isolation (STI) wafers having a starting thickness of greater than 6000 Å of HDP oxide. These wafers were also pre-polished to a smaller thickness (6000 Å) before being supplied to the tool under test. Silica-based conditioning time was again approximately 1 minute per dummy-wafer, but this time only 5 dummy-wafers (half the previous number) were used in the conditioning batch. Thus, the total break-in time was substantially less than 10 minutes and roughly about 5–6 minutes (counting time for roughening). The post-initialization ceria-based polishing was again end-point terminated with friction based detection of the nitride underlayer. The following Table 2 shows uniformity results across the second batch of nondummy-wafers.

TABLE 2

| STI Wafer No. after break in | Ending Oxide Thick (Å) | Oxide Thick Range (max-min, Å) | Measured time to end point detection (seconds) | Polish Rate = (6000-Thick)/time | Variation relative to AVG Polish Rate (22.87) | First wafer effect present ? |
|---|---|---|---|---|---|---|
| | | | Silica-slurry Break-in/Conditioning (Raw Data plus Normalized Data) | | | |
| 0 | 4951 | 168 | 44.6 | 23.52 | 2.84% | No |
| 1 | n/a | n/a | 46.6 | | | No |
| 2 | n/a | n/a | 46.0 | | | No |
| 3 | n/a | n/a | 45.8 | | | No |
| 4 | n/a | n/a | 43.3 | | | No |
| 5 | 4974 | 167 | 46.1 | 22.26 | −2.67% | No |
| 6 | n/a | n/a | 46.9 | | | No |
| 7 | n/a | n/a | 45.2 | | | No |
| 8 | n/a | n/a | 45.4 | | | No |
| 9 | n/a | n/a | 46.5 | | | No |
| 10 | n/a | n/a | 45.8 | | | No |
| 11 | n/a | n/a | 45.5 | | | No |
| 12 | n/a | n/a | 43.5 | | | No |
| 13 | n/a | n/a | 43.7 | | | No |
| 14 | n/a | n/a | 44.0 | | | No |
| 15 | 4970 | 153 | 45.2 | 22.79 | −0.35% | No |
| 16 | n/a | n/a | 44.8 | | | No |

TABLE 2-continued

| Silica-slurry Break-in/Conditioning (Raw Data plus Normalized Data) | | | | | | |
|---|---|---|---|---|---|---|
| STI Wafer No. after break in | Ending Oxide Thick (Å) | Oxide Thick Range (max-min, Å) | Measured time to end point detection (seconds) | Polish Rate = (6000-Thick) / time | Variation relative to AVG Polish Rate (22.87) | First wafer effect present ? |
| 17 | n/a | n/a | 44.9 | | | No |
| 18 | n/a | n/a | 43.1 | | | No |
| 19 | n/a | n/a | 31.1 | ** | | ** |
| 20 | 4979 | 177 | 20.0 | ** | n/a | ** |
| 21 | n/a | n/a | 32.7 | ** | | ** |
| 22 | n/a | n/a | 21.7 | ** | | ** |
| 23 | n/a | n/a | 23.0 | ** | | ** |
| AVG of 1–18 | 4968 | | 45.13 | 22.87 | 0% | |

Once again for Table 2, there was an unexplained anomaly for wafers at the end of the batch. Thus wafer numbers 19–23 are not counted in calculation of the batch average. (The anomalous rows are marked by double asterisks, ) The calculated, normalized polish rate (polish to end-point) for the batch average (counting only wafers 1–18) was 22.87 Å/seconds. In line with this, the calculated polish rate for wafer number 0 (the first wafer after pad break-in) was about 23 Å/sec, which is roughly 3% faster than the rest of the batch. Because the polishing rate of wafer#0 is now bigger rather than smaller than the batch average, this indicates that there is no first wafer effect here. The pad's conditioning has already stabilized with respect to non-dummy wafers. Calculated variation of polish rate for wafer numbers 5 and 15** was also relatively small. It may be fairly concluded that this small variation indicates the first wafer effect is no longer present. The change may be attributed to the silica-based pad break-in process used for the batch run of Table 2.

Incidentally, it may appear that the results of Table 2 are worse because polish-to-end point times in Table 2 are generally longer than those of Table 1. However, the incoming wafers for the Table 2 run had a different planarity. Also, the composition of the HDP oxide in the run of Table 2 may have been significantly different. Therefore, the absolute polish times of Table 1 and Table 2 may be different for reasons unrelated to the pad break-in process. (Oxide composition within a given batch is assumed to be fairly consistent from wafer to wafer.)

In a third experiment (Table 3), pad break-in and post break-in conditioning were carried using only a silica-based slurry. Polishing of the patterned wafers was also conducted with the same ceria-based slurry as in the baseline first experiment. The patterned wafers were again constituted by Shallow Trench Isolation (STI) wafers having a starting thickness of greater than 6000 Å of HDP oxide. These wafers were also pre-polished to a smaller thickness (6000 Å) before being supplied to the tool under test. The experiment of Table 3 was primarily directed to studying consistency of an end-point algorithm, which is why thickness of the silicon nitride pad layer was also measured. Unfortunately, the ending oxide thickness value for wafer #0 was not obtained. Rather than providing calculations for average polish rate, the results of Table 3 provide variation of the polish time as measured to end point. It may be seen that wafer #0 of Table 3 had a polish time to end point which is not very different from the average time of wafers #1–23. (Wafer #24 ** was not included in the average because it appears that some anomalous behavior, not related to first wafer effect, occurred at the end of the batch.) End of polish nitride thickness also showed good results for the end-point algorithm that was being tested by the experiment of Table 3.

TABLE 3

| Silica-slurry Break-in/Conditioning (Raw Data plus Averaged Data) | | | | | | | |
|---|---|---|---|---|---|---|---|
| STI Wafer No. after break in | Measured time to end point detection (seconds) | Ending Oxide Thick (Å) | Oxide Thick Range (max–min, Å) | Ending Nitride Thick (Å) | Nitride Thick Range (max–min, Å) | Variation relative to AVG Polish Time (51.42) | First wafer effect present? |
| 0 | 52.7 | n/a | n/a | 849 | 20 | 2.49% | No |
| 1 | 56.7 | n/a | n/a | | n/a | 10.27% | No |
| 2 | 47.9 | n/a | n/a | | n/a | −6.85% | No |
| 3 | 46.2 | n/a | n/a | | n/a | −10.15% | No |
| 4 | 46.6 | n/a | n/a | | n/a | −9.37% | No |
| 5 | 45.9 | 5140 | 167 | 849 | 19 | −10.74% | No |
| 6 | 47.9 | n/a | n/a | | n/a | −6.85% | No |
| 7 | 47.7 | n/a | n/a | | n/a | −7.23% | No |
| 8 | 51.8 | n/a | n/a | | n/a | 0.74% | No |
| 9 | 50.3 | n/a | n/a | | n/a | −2.18% | No |
| 10 | 54.0 | 5158 | 149 | 847 | 24 | 5.02% | No |

TABLE 3-continued

| STI Wafer No. after break in | Measured time to end point detection (seconds) | Silica-slurry Break-in/Conditioning (Raw Data plus Averaged Data) Ending Oxide Thick (Å) | Oxide Thick Range (max–min, Å) | Ending Nitride Thick (Å) | Nitride Thick Range (max–min, Å) | Variation relative to AVG Polish Time (51.42) | First wafer effect present? |
|---|---|---|---|---|---|---|---|
| 11 | 55.8 | n/a | n/a | | n/a | 8.52% | No |
| 12 | 52.3 | n/a | n/a | | n/a | 1.71% | No |
| 13 | 44.3 | n/a | n/a | | n/a | −13.85% | No |
| 14 | 56.6 | n/a | n/a | | n/a | 10.07% | No |
| 15 | 50.1 | n/a | n/a | | n/a | −2.57% | No |
| 16 | 49.9 | n/a | n/a | | n/a | −2.96% | No |
| 17 | 55.7 | n/a | n/a | | n/a | 8.32% | No |
| 18 | 53.7 | n/a | n/a | | n/a | 4.43% | No |
| 19 | 53.4 | n/a | n/a | | n/a | 3.85% | No |
| 20 | 56.5 | 5144 | 172 | 849 | 19 | 9.88% | No |
| 21 | 51.9 | n/a | n/a | | n/a | 0.93% | No |
| 22 | 53.1 | n/a | n/a | | n/a | 3.27% | No |
| 23 | 53.0 | n/a | n/a | | n/a | 3.07% | No |
| 24 | 60.0 | n/a | n/a | | n/a | 16.69% | ** |
| AVG of 0–23 | 51.42 | n/a | n/a | n/a | n/a | 0.00% | |

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, and/or use of equivalent functional steps for steps described herein. Such insubstantial variations are to be considered within the scope of what is contemplated here. Moreover, if plural examples are given for specific means, or steps, and extrapolation between and/or beyond such given examples is obvious in view of the present disclosure, then the disclosure is to be deemed as effectively disclosing and thus covering at least such extrapolations.

Reservation of Extra-Patent Rights, Resolution of Conflicts, and Interpretation of Terms After this disclosure is lawfully published, the owner of the present patent application has no objection to the reproduction by others of textual and graphic materials contained herein provided such reproduction is for the limited purpose of understanding the present disclosure of invention and of thereby promoting the useful arts and sciences. The owner does not however disclaim any other rights that may be lawfully associated with the disclosed materials, including but not limited to, copyrights in any computer program listings or art works or other works provided herein, and to trademark or trade dress rights that may be associated with coined terms or art works provided herein and to other otherwise-protectable subject matter included herein or otherwise derivable herefrom.

If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

Unless expressly stated otherwise herein, ordinary terms have their corresponding ordinary meanings within the respective contexts of their presentations, and ordinary terms of art have their corresponding regular meanings within the relevant technical arts and within the respective contexts of their presentations herein.

Given the above disclosure of general concepts and specific embodiments, the scope of protection sought is to be defined by the claims appended hereto. The issued claims are not to be taken as limiting Applicant's right to claim disclosed, but not yet literally claimed subject matter by way of one or more further applications including those filed pursuant to 35 U.S.C. §120 and/or 35 U.S.C. §251.

What is claimed is:

1. A polishing method for use in a chemical mechanical polishing (CMP) tool which uses an in-tool polishing pad and one or more supplied ceria (CeO2) based CMP slurries for in-tool chemical mechanical polishing of supplied workpieces, the method comprising:

(a) roughening the in-tool polishing pad;

(b) providing a batch of dummy workpieces within the CMP tool;

(c) using one or more of the in-tool dummy workpieces in combination with a supplied one or more silica (SiO2) based CMP slurries to initialize the roughened polishing pad;

(d) transferring a batch of non-dummy workpieces into the CMP tool; and (e) using the initialized polishing pad and one or more of the in-transferred non-dummy workpieces in combination with one or more ceria (CeO2) based CMP slurries to polish the one or more of the in-transferred non-dummy workpieces.

2. The polishing method of claim 1 wherein:

said roughening creates a statistically uniform distribution of additional grooves, channels, and/or other kinds of surface voids and/or indentations defined uniformly across a working surface of the in-tool polishing pad, where said surface voids and/or indentations are operative for containing and moving said one or more ceria (CeO2) based CMP slurries.

3. The polishing method of claim 1 and further wherein:
(a.1) said roughening includes sweeping the polishing pad at least about 20 successive times with a roughening device.

4. The polishing method of claim 3 wherein:
(a.1a) said roughening includes sweeping the polishing pad at least about 50 successive times with the roughening device.

5. The polishing method of claim 1 and further wherein:
(b.1) said batch of dummy workpieces includes at least 5 unpatterned semiconductor wafers; and
(c.1) said using step uses about 5 of the at least 5 unpatterned semiconductor wafers to initialize the polishing pad.

6. The polishing method of claim 1 and further wherein:
(d.1) said batch of non-dummy workpieces includes at least 10 pre-patterned semiconductor wafers.

7. The polishing method of claim 1 and further comprising:
(f) terminating said initializing of the roughened polishing pad after a predetermined amount of elapsed polishing time with the dummy-workpieces and/or after a predetermined number of polishing revolutions; and
(g) terminating said polishing of the one or more non-dummy workpieces in response to an end-point detection test.

8. The polishing method of claim 1 and further wherein:
(a.1) the polishing pad that is roughened is a new pad which has not been roughened before said roughening step.

9. A polishing method comprising:
(a) installing a polishing pad into a chemical mechanical polishing (CMP) tool which uses one or more ceria (CeO2) based CMP slurries for chemical mechanical polishing of non-dummy workpieces;
(b) roughening the installed polishing pad;
(c) transferring a batch of dummy workpieces into the CMP tool;
(d) using one or more of the in-transferred dummy workpieces in combination with one or more silica (SiO2) based CMP slurries to initialize the roughened and installed polishing pad;
(e) transferring the batch of dummy workpieces out from the CMP tool;
(f) transferring a batch of non-dummy workpieces into the CMP tool; and
(g) using the initialized polishing pad and one or more of the in-transferred non-dummy workpieces in combination with one or more ceria (CeO2) based CMP slurries to polish the one or more of the in-transferred non-dummy workpieces.

10. The polishing method of claim 9 wherein:
(a.1) said installing includes installing a new polishing pad which has a relatively planar working surface that has not been previously roughened.

11. The polishing method of claim 9 wherein:
(b.1) said roughening creates a statistically uniform distribution of grooves, channels, and/or other kinds of surface voids and/or indentations defined uniformly across a working surface of the installed polishing pad, where said surface voids and/or indentations are operative for containing and moving said one or more ceria (CeO2) based CMP slurries.

12. The polishing method of claim 9 wherein:
(b.1) said roughening includes sweeping the installed polishing pad at least about 20 successive times with a roughening device.

13. The polishing method of claim 9 and further comprising:
(h) terminating said conditioning of the roughened polishing pad after a predetermined amount of elapsed polishing time with the dummy-workpieces; and
(i) terminating said polishing of the one or more non-dummy workpieces in response to an end-point detection test.

14. The polishing method of claim 13 wherein said end-point detection includes at least one of optical detection, force feedback detection, temperature detection, and chemical composition detection.

15. An instruction conveying device for conveying to an instructable chemical mechanical polishing (CMP) tool, manufactured instructing signals that cause said CMP tool to carry out a polishing method comprised of:
(a) roughening an installed polishing pad;
(b) moving a batch of dummy workpieces for use within the CMP tool;
(c) using one or more of the moved dummy workpieces in combination with one or more silica (SiO2) based CMP slurries to initialize the roughened polishing pad;
(d) transferring a batch of non-dummy workpieces into the CMP tool; and
(e) using the initialized polishing pad and one or more of the in-transferred non-dummy workpieces in combination with one or more ceria (CeO2) based CMP slurries to polish the one or more of the in-transferred non-dummy workpieces.

16. The instruction conveying device of claim 15 wherein:
(a.1) said roughening creates a statistically uniform distribution of grooves, channels, and/or other kinds of surface voids and/or indentations defined uniformly across a working surface of the installed polishing pad, where said surface voids and/or indentations are operative for containing and moving said one or more ceria (CeO2) based CMP slurries.

17. The instruction conveying device of claim 15 wherein:
(a.1) said roughening includes sweeping the installed polishing pad at least about 20 successive times with a roughening device.

18. The instruction conveying device of claim 15 and wherein the machine-implemented and instructed polishing method is further comprised of:
(f) rinsing and conditioning the roughened pad before said initializing of the pad; and
(g) rinsing and conditioning the initialized pad before said using (e) of the initialized polishing pad with said one or more ceria (CeO2) based CMP.

* * * * *